US005967382A

United States Patent [19]

Lasserre et al.

[11] Patent Number: 5,967,382

[45] Date of Patent: Oct. 19, 1999

[54] VALVE FOR A DEVICE FOR PACKAGING AND DISPENSING A PRESSURIZED LIQUID, AND A DEVICE THUS EQUIPPED

[75] Inventors: Pierre-Andre Lasserre, Coubron; Jean-Marc Aumegeas, Maisons Laffitte, both of France

[73] Assignee: L'oreal, Paris, France

[21] Appl. No.: 08/991,860

[22] Filed: Dec. 16, 1997

[30] Foreign Application Priority Data

Dec. 24, 1996 [FR] France ..... 96 15981

[51] Int. Cl.[6] ..... B65D 83/00; B67D 3/00; B05B 1/30

[52] U.S. Cl. ..... 222/402.2; 222/402.23; 222/517; 239/577

[58] Field of Search ..... 239/577; 222/402.2, 222/402.21, 402.22, 402.23, 513, 517

[56] References Cited

U.S. PATENT DOCUMENTS

| | | | |
|---|---|---|---|
| 2,621,014 | 12/1952 | Efford . | |
| 2,831,617 | 4/1958 | Soffer | 222/402.22 |
| 3,735,955 | 5/1973 | Kerr et al. | 222/402.21 |
| 3,785,536 | 1/1974 | Graham | 222/402.21 |
| 4,171,074 | 10/1979 | Diamond | 222/402.22 |
| 4,426,026 | 1/1984 | Knickerbrocker . | |
| 5,137,180 | 8/1992 | Kieras | 222/402.21 |

FOREIGN PATENT DOCUMENTS

| | | |
|---|---|---|
| 2 161 350 | 7/1973 | France . |
| 2 390 650 | 12/1978 | France . |
| 2161350 | 12/1978 | France . |
| 10 37 377 | 8/1958 | Germany . |
| 1037377 | 8/1958 | Germany . |
| WO 8202533 | 8/1982 | WIPO . |

*Primary Examiner*—Andres Kashnikow
*Assistant Examiner*—Keats Quinalty
*Attorney, Agent, or Firm*—Oblon, Spivak, McClelland, Maier & Neustadt, P.C.

[57] ABSTRACT

A dispensing valve includes a body with an axis defining an internal chamber communicating with a pressurized liquid. The body has an intake duct and an outlet duct. The valve also includes an actuating stem traversed by a dispensing duct open at its two ends, the stem being mounted in a leakproof manner in the outlet duct, one of its ends having at least one feeder passage and the other end opening outside the body. The feeder passage is selectively communicated with the internal chamber by lateral pivoting of the stem so as to allow the liquid to be dispensed via the dispensing duct. The valve body is made of an elastomeric material, and the stem has, inside the outlet duct, a profile capable of cooperating with a complementary profile of the outlet duct to define an articulation substantially around a point so that, irrespective of the angular position of the stem relative to the axis, the stem is in a leakproof annular contact with the outlet duct.

20 Claims, 2 Drawing Sheets

VALVE FOR A DEVICE FOR PACKAGING AND DISPENSING A PRESSURIZED LIQUID, AND A DEVICE THUS EQUIPPED

BACKGROUND OF THE INVENTION

1. Field of the Invention

The present invention relates to a valve for dispensing a product, intended to equip a dispenser comprising a container capable of containing a liquid stored under pressure under the action of a propellant gas. The invention also relates to a dispenser equipped with such a valve. This dispenser is more particularly intended for the packaging and dispensing of a fluid product, such as a cosmetic, dermatological, household, food or industrial product, such as, for example, a hair lacquer, a disinfectant spray, a paint or a cleaning product.

2. Description of the Related Art

The valve of the invention equipping this dispenser is of the type which comprises a manipulating stem disposed axially in a valve body. The manipulating stem has a passage for the product to be dispensed. The valve comprises sealing means capable of closing the passage, the manipulating stem being capable of being elastically displaced by the lateral pivoting of this stem in the valve body between a first position of obturating the passage where the stem is in the axial position, in which first position the passage is separated from the pressurized product by the sealing means, and a second open position where the stem is inclined relative to the axis of the valve body, in which second position the said passage communicates with the pressurized product, to allow the dispensing of the product. The valve comprises, moreover, nonmetallic biasing means urging the stem into first position. Moreover, the opening of the valve can also be produced axially by an axial depression, which is advantageous for the filling of the container on a packaging assembly line.

A valve is known, for example from French Patent No. 2 161 350, which comprises a manipulating stem disposed in a valve body formed of an elastomeric material. The actuation of this valve is effected by the axial depression of the manipulating stem against elastic biasing means. These means are constituted by a part of the valve body bearing against the stem. According to the French Patent No. 2 161 350, the valve is designed to be actuated by the axial depression of the stem.

A valve is, moreover, known which can be actuated by a lateral pivoting of the manipulating stem. Thus U.S. Pat. No 3,627,179 describes a pivoting valve comprising a stem provided with a sealing crown and acted on by elastic biasing means. The crown is in leakproof contact with an attached annular gasket made of an elastomer. A metal cup is provided to join the gasket to a valve body. The elastic biasing means are obtained by a bottom of the valve body of a small thickness so that, during the lateral pivoting of the stem, the crown elastically deforms the bottom.

This valve has the following drawbacks: during repeated actuations of the valve, there is the risk that the bottom will break, which will produce the uncontrolled dispersion of the whole contents into the atmosphere. Moreover, the actuating force necessary for the dispensing of the product is not constant. Rather, due to the variation of the internal pressure of the dispenser, this actuating force is also variable.

SUMMARY OF THE INVENTION

It is an object of the present invention to remedy the drawbacks of the conventional valves.

It is a further object of the invention to provide a valve which is of a simple design and which is easy to mount on any type of pressurized container.

It is yet a further object of the invention to provide a valve which is low in cost.

It is yet a further object of the invention to provide a valve having no metal parts.

According to a feature of the invention, the above and other objects are achieved by a dispensing valve made entirely of a polymeric material and comprising a valve body provided with a longitudinal axis, defining an internal chamber communicating with the product, the valve body having an intake opening and an outlet duct; an actuating stem traversed by a dispensing duct open at its two ends, the actuating stem being mounted in a leakproof manner in the outlet duct, one of its ends having at least one feeder passage, the other end opening out outside the valve body; and means for selectively causing the feeder passage to communicate with the internal chamber by the lateral pivoting of the valve stem, so as to allow the product to be dispensed via the dispensing duct. In accordance with the invention, the valve body is made of an elastomeric material and the valve stem has, inside the outlet duct, a profile capable of cooperating with a complementary profile of the outlet duct to define an articulation substantially around a point so that, irrespective of the angular position of the stem relative to the axis, the stem is in leakproof annular contact with the duct.

According to a first embodiment, the stem has, inside the outlet duct, an annular portion forming a projection relative to the rest of the stem, and whose cross-section is of a spherical shape having a geometrical center, the outlet duct having a portion forming a reinforcing portion of a shape complementary to that of the portion forming the projection and capable of receiving in a leakproof manner the portion forming the projection, the articulation point of the stem substantially coinciding with the geometrical center. Preferably, the annular portion forming the projection has an external diameter of approximately 4 mm to 7 mm, the rest of the stem having a diameter of from 3 mm to 4 mm.

When the complementary reinforcement portion in the outlet duct is subjected to any elastic strain, it has a radius of curvature of approximately 10% to approximately 30% smaller than the radius of curvature of the portion forming the projection. Thus, a leakproof tight hold of the stem in the valve body is obtained, and this is irrespective of the pivoting position of the stem.

According to a second embodiment, inside the outlet duct, the stem has a portion forming a recess in the shape of an annular throat, in the form of a portion of a torus having a geometrical center, the outlet duct having a portion forming a projection of a shape complementary to that of the recess and capable of receiving the annular throat in a leakproof manner, the point of articulation of the stem coinciding with the geometrical center of the torus. Advantageously, when the portion forming the projection is subjected to any elastic strain, it has a radius of curvature smaller by approximately 10% to approximately 30% than the radius of curvature of the portion forming a recess. In this case too, there occurs a leakproof tight hold of the stem in the outlet duct of the valve body.

According to an advantageous aspect of the invention, the means for selectively causing the end of the stem opening out in the valve body to communicate with the internal chamber comprise a sealing crown acted on by elastic biasing means, bearing in a leakproof manner on an annular seat formed by the body.

To facilitate the lateral pivoting of the stem in the outlet duct of the valve body, the distance along the axis of the stem between the articulation point and the annular seat is advantageously from 3 mm to 4 mm. For the same reasons, the valve body may have between the articulation point and the seat a frustoconical portion, whose smaller diameter is orientated towards the articulation point.

The stem and the sealing crown are preferably made of a single piece and are formed of a rigid thermoplastic material, such as polypropylene. In particular, the sealing crown, which is advantageously joined to the stem, is accommodated in the valve chamber and is urged in a compression mode by the elastic biasing means onto the annular seat of the body surrounding the stem. Thus, when the manipulating stem is at rest, the annular seat ensures a perfect seal between the outer side of the stem and the valve chamber and the crown separates the valve chamber from the outlet duct of the stem in the closing position of the valve. Advantageously, the sealing crown is cylindrical. When the manipulating stem is actuated against the biasing means by a lateral pivoting, the crown moves partially away from the annular seat and a communication is established between the valve chamber and the outside, allowing the pressurized product to be dispensed.

To ensure the mobility of the sealing crown in the internal chamber, the chamber may have, between the seat and the intake opening, a frustoconical portion whose smaller diameter is orientated towards the intake opening. This frustoconical portion facilitates, in particular, the pivoting of the manipulating stem.

Advantageously, the dispensing duct of the stem opens out in the valve body via a passage passing radially through the stem in the vicinity of the sealing crown.

The elastic biasing means may be formed by at least one elastomeric stub carried by a side of the chamber and joined thereto, at least one stub being in an elastic bearing contact against a part carrying the crown. Advantageously, the stub or each stub is formed integrally with the valve body. When the valve chamber comprises a bottom formed by a frustoconical portion, at least one stub is disposed on this frustoconical portion. Advantageously, the number of stubs is 4 or 6. These stubs preferably have a small dimension in relation to the chamber, for example a height of the order of 0.5 mm to 3 mm. The one stub may be carried by a part carrying the crown and disposed on the opposite side to the sealing zone, in an elastic bearing contact against a side of the chamber.

The valve body may be made of any elastomeric material having a Shore A hardness of from 30 to 70.

Thus, the valve body is provided with sufficient elasticity to allow the manipulating stem to be mounted therein, and with sufficient rigidity to ensure its shape stability. Moreover, when the biasing means are made in the form of stubs carried by one of the sides delimiting the internal chamber, these stubs may be deformed by squashing during the actuation of the valve.

The valve of the invention is intended to equip a dispenser for a liquid product. It is designed, more particularly, to be mounted on the neck of a container filled with the product and pressurized by means of a propellant gas.

According to a particular embodiment of the invention, this dispenser does not have a metal cup generally used for securing a valve on a container, and the valve is mounted directly on the neck of the container. In this case, the neck is shaped so that it can cooperate with the catch engagement means of the valve. Therefore, the assembly of the valve body on the container can be effected without recourse to a conventional cup, since the elasticity of the material forming the valve body ensures both the deformation necessary for the mounting of the valve body on the container and a sufficient seal to withstand the internal pressure of the container.

Thus, the valve in accordance with the invention is of a simple design and comprises only a small number of components. Indeed, it comprises only a manipulating stem and a valve body which are easy to assemble. Moreover, this valve does not include any component made of metal, which is liable to come into contact with the product to be dispensed and which would risk the degradation of this product.

According to an advantageous embodiment of the invention, the valve body comprises, moreover, external catch engagement means capable of cooperating with an opening of a container for a liquid product, whereon the valve is mounted with a view to the dispensing of the product. Advantageously, these catch engagement means are formed by an annular groove cut into the outer side of the valve body.

The container on which this valve can be mounted can be made of aluminum, tin or plastic material. For this purpose, the container has an open end (or opening) capable of cooperating with the catch engagement means of the valve body.

Thus, the valve of the invention can be mounted on such a container by a simple driving-in operation, and does not additionally require intermediate components or gaskets. Another advantage lies in the fact that the containers capable of being joined to the valve of the invention can be chosen from simple, and hence economically advantageous, containers. For this purpose, the opening of the container in which the valve body has to be mounted may in particular have relatively large tolerances, and the mounting of the valve on the container does not require any particular and hence expensive machining.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
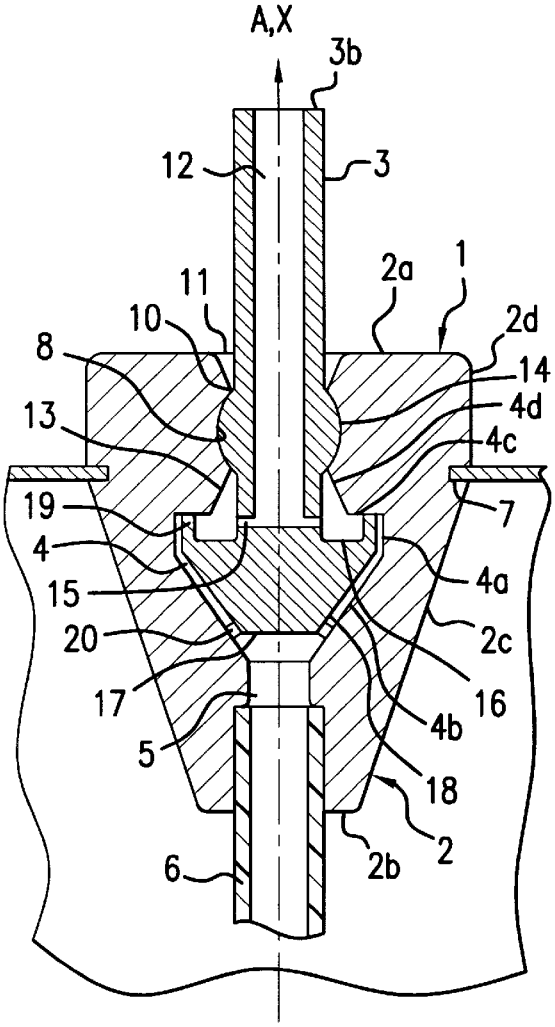
FIG. 1 is an axial section of a first embodiment of a valve in accordance with the invention, in its closed position.
Figure 2:
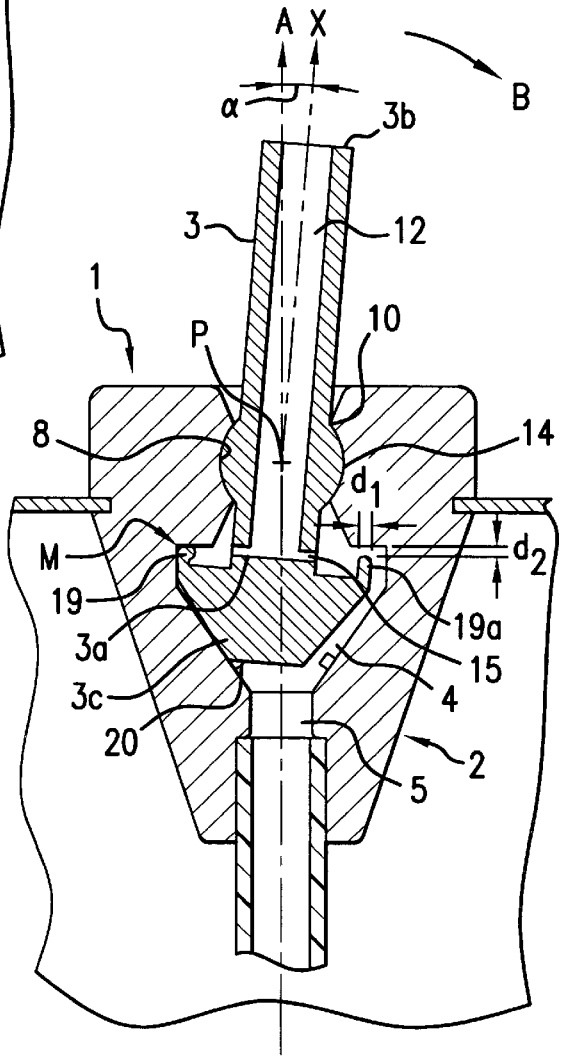
FIG. 2 is an axial section of the valve of FIG. 1, in its open position.

The valve in accordance with the invention shown in FIGS. 1 and 2, respectively in its closed position and open position, is intended to equip a dispenser containing a liquid product, such as, for example, a hair lacquer, pressurized by the action of a propellant gas. As may be seen, in particular in FIG. 1, the valve 1 comprises a body 2 having a general frustoconical shape with an axis A of revolution, and a manipulating stem 3 of a generally cylindrical shape, provided with an axis X. In the rest position of the valve, the axes A and X coincide. The stem 3 is made of a rigid thermoplastic material.

In accordance with the invention, the valve body 2 is made of an elastically deformable material, for example an elastomer of nitrile rubber, whose Shore A hardness is in the range of from 30 to 70. The body has a large base 2*a* and a small base 2*b* joined by a frustoconical portion 2*c* and a cylindrical portion 2*d*.

Inside the valve body 2 there is arranged an internal chamber 4 with a circular cross-section, which is defined by circumferential sides. The side 4*a* has a cylindrical shape and is joined via an axial intake duct 5 to a first frustoconical portion 4*b* whose top opens out towards the outside of the valve chamber.

The axial intake duct 5, intended for the intake of the product to be dispensed, is formed at the center of the small base 2*b* and opens out in the chamber 4. This intake duct 5 is connected to a dip tube 6 whose free end (not shown) permanently dips into the product. This product is packaged in a container fitted with the valve 1 (see FIG. 4).

On the side opposite to the intake duct 5, a cylindrical wall 4*a* is joined to an annular sealing zone or seat 4*c* situated in a plane perpendicular to the axis A. The annular zone or seat 4*c* is extended upwards by a second frustoconical portion 4*d* facilitating the pivoting of the stem 3. The top of the frustoconical portion 4*d* opens out in a substantially spherically shaped reinforcing portion 8. This reinforcing portion 8 forms part of an outlet duct 10 which is disposed in the extension of the intake duct 5, the duct 10 leading outwardly from the internal chamber 4. The outlet duct 10 is traversed by the stem 3 whose external side is in perfect sealing contact against the side delimiting the outlet duct 10. Substantially halfway up the outlet duct 10, the stem 3 has an annular portion 14 forming a projection relative to the rest of the stem, and whose axial cross-section has a spherical shape complementary to the shape of the reinforcing portion 8. A free end 11 of the outlet duct 10 has a conical bore, while the other end 13 of the outlet duct 10 opens to form the abovementioned zone or seat 4*c*.

The stem 3 comprises a central dispensing duct 12 passing through the stem from the emergent end 3*b* as far as a level situated substantially at the height of the annular zone or seat 4*c*. At this height, the central duct 12 ends in a radial passage 15 passing radially through the stem 3 and opening out in the upper portion of the chamber 4. A lower end portion 3*a* is shaped as a cone frustum 3*c* and has a large base 16 and a small base 17 joined by a frustoconical portion 18. The large base 16 carries a circumferential crown 19 in an elastic leakproof bearing contact against the annular zone 4*c* which then forms a seat. In practice, the ring has radially a small thickness $d_1$, (approximately 0.1 to 0.5 mm as shown in FIG. 2). The elastic bearing contact of the crown 19 against the zone or seat 4*c* is provided by several stubs 20 regularly interspaced over the circumference of the first frustoconical side portion 4*b* of the chamber 4 and being in an elastic bearing contact against the frustoconical portion 18 of the stem 3. Thus, a free edge 19*a* of the crown 19 enters some tenths of a mm into the zone or seat 4*c* and creates a perfect seal between the valve chamber 4 and the dispensing duct 12.

According to another embodiment, the stubs 20 may be placed on the cone frustum 3*c* of the stem 3 and may be molded integrally with the stem. These stubs 20 are in an elastic bearing contact against the first frustoconical side portion 4*b*. Thus, during the actuation of the valve 1 by pivoting the stem 3, the stubs 20 partially enter into the side portion 4*b*.

The stem 3, (including the cone frustum 3*c*) is made of a relatively rigid thermoplastic material such as polypropylene. Its diameter is approximately 3 mm to approximately 4 mm, and its outer annular portion forms a projection 14 having an internal diameter from 4 mm to 7 mm. In this case, the complementary reinforcing portion 8, when subjected to any elastic strain, has an internal diameter approximately 10% to 30% smaller than the external diameter of the portion forming the projection 14. Advantageously, the center P of the projecting portion 14 is disposed at an axial height along axis A situated 3 mm to 4 mm from the zone or seat 4*c*.

A transition zone of the valve body, situated between the cylindrical portion 2*d* and the frustoconical portion 2*c* of the body 2, comprises catch engagement means 7 in the form of an annular securing groove whose function will be explained during the description of FIG. 4.

The operation of the valve 1 is schematically outlined in FIG. 2. To produce the opening of the valve 1, the stem 3 is caused to pivot around the articulation point P in the direction of arrow B; during the pivoting, the axis X of the stem 3 is inclined relative to the axis A of the valve body 2, the angle $\alpha$ formed between the two axes being of the order of 2° to 10°. During this pivoting, the free edge 19*a* moves away from the seat 4*c*, creating a gap of a distance $d_2$. At the stub same time, the or each stub 20 which is situated on the first frustoconical side portion 4*b* opposite to the gap of distance $d_2$ is squashed by the frustoconical portion 3*c* of the stem 3. In the example of the embodiment in question, four stubs 20 of an elongate shape have been obtained with a height of approximately 1 mm, a width of approximately 1.5 mm and a length of approximately 15 mm. Under the thrust of a propellant gas, the product is then passed towards the dip tube 6 and the intake opening 5 in the chamber 4, to arrive in the dispensing duct 12 via the interspacing gap of distance $d_2$ and the radial passage 15. When the pivoting stops, the dispensing of the product stops, since the crown 19 returns into leakproof contact against the seat 4*c*. Thus, during pivoting of the stem 3 in the outlet duct 10, it remains in leakproof annular contact with the duct at the level of the whole or part of its spherical portion 14.

Figure 3:
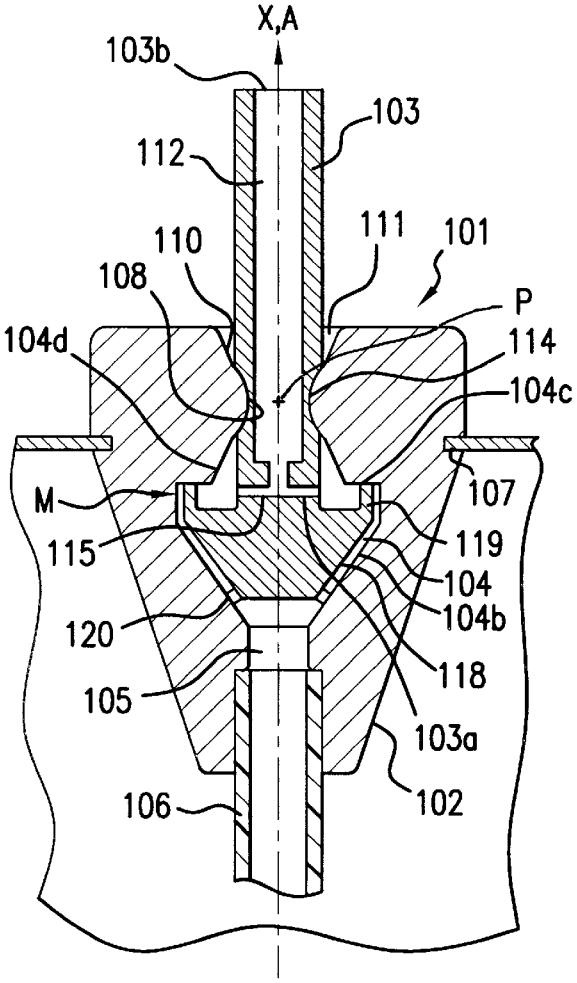
FIG. 3 is an axial section of a second embodiment of the valve in accordance with the invention.

In FIG. 3, there is shown a second embodiment of a valve 101 in accordance with the invention. This valve 101, shown in its rest position, is distinguished from that of FIGS. 1 and 2 in that the shape of the profile of the annular portion of a stem 103, as well as of the complementary profile of an outlet duct 110, are reversed. The parts of the valve 101 identical with, or performing functions similar to, the parts of the valve 1 of FIGS. 1 and 2 bear the same reference numerals increased by 100. Their description will only be repeated succinctly.

Thus, the valve stem 103 passes through the outlet duct 110 which connects the valve chamber 104 to the outside. Inside the outlet duct 110, the stem 103 has, substantially halfway up, a portion 114 forming a recess in the shape of an annular throat, in the form of a portion of a torus having a geometrical center P. The outlet duct 110 has a portion 108 forming a projection of a shape complementary to that of the recess 114 and capable of receiving the annular throat in a leakproof manner, the point of articulation of the stem 103 coinciding with the geometrical center P of the torus. The valve 103 functions in a way similar to the functioning of the valve 1.

Figure 4:
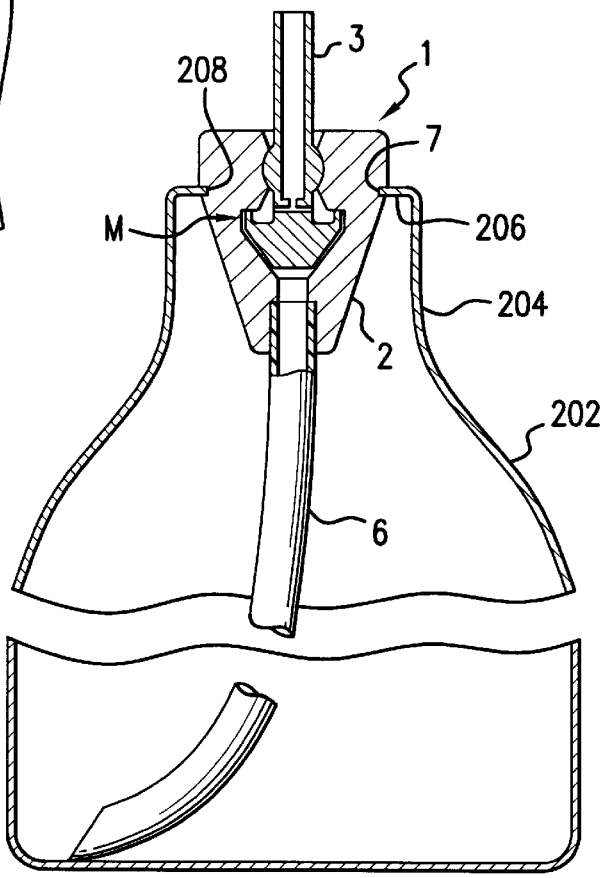
FIG. 4 is a partial axial section of a container fitted with the valve of FIG. 1 and without a valve carrier cup.

In FIG. 4, the valve 1 in accordance with FIGS. 1 and 2 will be seen mounted on a container 202 without a valve carrier cup. This container 202 is a bottle made of aluminum, in particular in one piece, or of a rigid plastic material, such as polyethylene terephthalate (PET). The container 202 has a neck 204 whose open end is bent at right angles, forming an annular plate 206 provided with a circular opening 208.

The body 2 of the valve 1 is fixed in the opening 208 by a force fit (driving it in), so that the annular plate 206 enters the annular groove 7 of the valve body 2. Because of the elasticity of the body 2, the driving in of the body 2 into the opening 208 can be effected by a simple operation. Moreover, where the opening 208 has any variations in diameter, the relatively large tolerances are compensated by the elasticity of the valve body 3 without any risk of the propellant gas escaping. This mounting is particularly advantageous from an economic aspect.

Obviously, numerous modifications and variations of the present invention are possible in light of the above teachings. It is therefore to be understood that the invention may be practiced otherwise than as specifically described herein.

We claim:

1. A valve for dispensing a product in the form of a liquid, mousse or gel, comprising:

a) an elastomeric valve body defining an internal chamber communicating with the product via an intake opening, and an outlet duct extending along an axis of the valve body;

b) an actuating stem pivotally mounted in the outlet duct and traversed by a dispensing duct open at two ends, one end of the dispensing duct having at least one feeder passage, the other end of the dispensing duct opening outside the valve body, wherein the valve stem and the outlet duct have complementary profiles cooperating to define an articulation substantially around a point, said articulation providing leakproof annular contact between said valve stem and said outlet duct at any angular position of the stem relative to the axis; and c) means for selectively causing the feeder passage to communicate with the internal chamber upon pivoting of the valve stem, so as to allow the product to be dispensed via said dispensing duct; and wherein said means is arranged so as also to cause the feeder passage to communicate with the internal chamber when an axial pressure is applied to the valve stem.

2. A dispensing valve according to claim 1, wherein said complementary profile of said stem comprises an annular portion forming a projection relative to a remainder of the stem, said annular portion having a spherical shape with a geometrical center, and wherein said complementary profile of said outlet duct comprises a reinforcing portion sealingly receiving said annular portion, the articulation point of the stem substantially coinciding with the geometrical center.

3. A dispensing valve according to claim 2, wherein the annular portion has an external diameter of about 5 to 7 mm, the remainder of the stem having a diameter of from 3 to 4 mm.

4. A dispensing valve according to claim 2, wherein said reinforcing portion, when subjected to an elastic strain, has a radius of curvature smaller, by approximately 10% to approximately 30%, than a radius of curvature of the annular portion.

5. A dispensing valve according to claim 1, wherein said complementary profile of said stem comprises a recess in the shape of an annular throat in the form of a portion of a torus, wherein the complementary profile of said outlet duct has a portion forming a projection of a shape complementary to that of the recess and receiving said annular throat in a leakproof manner, the point of articulation of the stem coinciding with a geometrical center of the torus.

6. A dispensing valve according to claim 5, wherein said portion forming the projection, when subjected to an elastic strain, has a radius of curvature smaller, by approximately 10% to approximately 30%, than a radius of curvature of the recess.

7. A dispensing valve according to claim 1, wherein said means for selectively causing the feeder passage to communicate with the internal chamber comprise a sealing crown and at least one elastic biasing element urging the sealing crown to sealingly bear on an annular seat of said body.

8. A dispensing valve according to claim 7, wherein an axial distance between the articulation point and the annular seat is from 3 mm to 4 mm.

9. A dispensing valve according to claim 7, wherein the valve body has, between the articulation point and the seat, a frustoconical portion whose smaller diameter is orientated towards the articulation point.

10. A valve according to claim 7, wherein the stem and the crown are made of a rigid thermoplastic material.

11. A valve according to claim 7, wherein the elastic biasing element is formed by at least one stub on a part carrying the crown and in elastic bearing contact against a side of the chamber.

12. A dispensing valve according to claim 1, wherein the dispensing duct opens out in the valve chamber via a passage radially passing through the stem.

13. A valve according to claim 1, including a external catch engagement element on said valve body and cooperable with an opening of a container on which said valve is mounted.

14. A valve according to claim 13, wherein the catch engagement element comprises an annular groove.

15. A valve according to claim 1, wherein the material of the elastomeric valve body has a Shore A hardness in a range from 30 to 70.

16. A valve for dispensing a product in the form of a liquid, mousse or gel, comprising:

a) an elastomeric valve body defining an internal chamber communicating with the product via an intake opening, and an outlet duct extending along an axis of the valve body;

b) an actuating stem pivotally mounted in the outlet duct and traversed by a dispensing duct open at two ends, one end of the dispensing duct having at least one feeder passage, the other end of the dispensing duct opening outside the valve body, wherein the valve stem and the outlet duct have complementary profiles cooperating to define an articulation substantially around a point, said articulation providing leakproof annular contact between said valve stem and said outlet duct at any angular position of the stem relative to the axis; and c) means for selectively causing the feeder passage to communicate with the internal chamber upon pivoting of the valve stem, so as to allow the product to be dispensed via said dispensing duct;

wherein said means for selectively causing the feeder passage to communicate with the internal chamber includes a sealing crown and at least one elastic biasing element urging the sealing crown to sealingly bear on an annular seat of the valve body, and wherein, between the annular seat and the intake opening, the internal chamber has a frustoconical portion with a smaller diameter orientated towards the intake opening.

17. A valve for dispensing a product in the form of a liquid, mousse or gel, comprising:

a) an elastomeric valve body defining an internal chamber communicating with the product via an intake opening, and an outlet duct extending along an axis of the valve body;

b) an actuating stem pivotally mounted in the outlet duct and traversed by a dispensing duct open at two ends, one end of the dispensing duct having at least one feeder passage, the other end of the dispensing duct opening outside the valve body, wherein the valve stem and the outlet duct have complementary profiles cooperating to define an articulation substantially around a point, said articulation providing leakproof annular contact between said valve stem and said outlet duct at any angular position of the stem relative to the axis; and c) means for selectively causing the feeder passage to communicate with the internal chamber upon pivoting of the valve stem, so as to allow the product to be dispensed via said dispensing duct;

wherein said means for selectively causing the feeder passage to communicate with the internal chamber includes a sealing crown and at least one elastic biasing element urging the sealing crown to sealingly bear on an annular seat of the valve body, and wherein the elastic biasing element includes at least one elastomeric stub carried by a side of the chamber and joined to the chamber, the at least one stub being in an elastic bearing contact against a part carrying the crown.

18. A dispenser comprising a container filled with a liquid product pressurized by a propellant gas, and a valve for dispensing said product, wherein the valve comprises:

a) an elastomeric valve body defining an internal chamber communicating with the product via an intake opening, and an outlet duct extending along an axis of the valve body;

b) an actuating stem pivotally mounted in the outlet duct and traversed by a dispensing duct open at two ends, one end of the dispensing duct having at least one feeder passage, the other end of the dispensing duct opening outside the valve body, wherein the valve stem and the outlet duct have complementary profiles cooperating to define an articulation substantially around a point, said articulation providing leakproof annular contact between said valve stem and said outlet duct at any angular position of the stem relative to the axis; and c) means for selectively causing the feeder passage to communicate with the internal chamber upon pivoting of the valve stem, so as to allow the product to be dispensed via said dispensing duct;

wherein said means is arranged so as also to cause the feeder passage to communicate with the internal chamber when an axial pressure is applied to the valve stem.

19. A dispenser according to claim 18, including a external catch engagement element on said valve body, wherein the container has a collar cooperable with the catch engagement means.

20. A dispenser according to claim 19, wherein the valve is mounted directly on the neck of the container.

* * * * *